US005316180A

United States Patent [19]

Cleland

[11] Patent Number: 5,316,180

[45] Date of Patent: May 31, 1994

[54] BEVERAGE DISPENSING MACHINE WITH PRESSURIZED WATER AND SYRUP SUPPLIES

[76] Inventor: Robert K. Cleland, 11051 Via El Mercado, Los Alamitos, Calif. 90720

[21] Appl. No.: 841,093

[22] Filed: Feb. 25, 1992

[51] Int. Cl.[5] ..... B67D 5/08

[52] U.S. Cl. ..... 222/56; 222/67

[58] Field of Search ..... 222/56, 64, 67, 129.2, 222/145, 399

[56] References Cited

U.S. PATENT DOCUMENTS

| | | | |
|---|---|---|---|
| 3,394,847 | 7/1968 | Garrard | 222/67 |
| 3,995,770 | 12/1976 | Schwitters | 222/56 |
| 4,544,084 | 10/1985 | Cleland | 222/129.2 |
| 4,560,089 | 12/1985 | McMillin et al. | 222/67 |
| 5,000,352 | 3/1991 | Cleland | 222/129.2 |

*Primary Examiner*—Andres Kashnikow
*Assistant Examiner*—Philippe Derakshani
*Attorney, Agent, or Firm*—Georges A. Maxwell

[57] ABSTRACT

A noncarbonated beverage dispensing machine in combination with pressurized water and syrup supplies; the machine includes a beverage tank from which beverage is dispensed, a mixing head including normally closed electrically operated water and syrup valves connected with the water and syrup supplies and operable to conduct metered volumes of water and syrup into the beverage tank and a liquid level switching device in the beverage tank operating to simultaneously cause the valves to open when the liquid in the tank is at a predetermined low level and to cause the valves to close when the liquid level in the tank is at a predetermined high level. The water supply delivers a constant supply of water at a desired pressure to the water valve. The syrup supply includes a replaceable syrup tank holding a discrete volume of syrup, an elongate syrup line extends from the syrup tank to the mixing head and a gas supply delivers pressurized gas into the syrup tank at predetermined pressure to move syrup therein through the syrup line to the head. The head includes a normally open syrup actuated switching device between and connected with the syrup valve and syrup line and that operates to close when syrup at desired pressure is delivered to the syrup valve and to disable and prevent opening of the water valve when syrup is not supplied to the syrup valve at desired pressure and to thereby prevent a flow of water into the supply tank in the absence of a corresponding flow of syrup into that tank.

19 Claims, 3 Drawing Sheets

C
CO2
SYRUP
G
T
D
41
40
H
81
37
38
80
2
B
M
E
A
20
10
W
11
36
35
12
13
14
15
16
17
18
19

BEVERAGE DISPENSING MACHINE WITH PRESSURIZED WATER AND SYRUP SUPPLIES

BACKGROUND OF THE INVENTION

This invention relates to that class of beverage dispensing machine that is characterized by a transparent beverage supply tank atop a base and having a manually accessible dispensing valve by which beverage in the beverage tank can be dispensed a serving at a time. This class of machines is ordinarily set atop a service counter where beverages are sold and dispensed and so that the beverage in the beverage tank is displayed to entice customers.

The above-noted class of beverage machine was originated in the 1920s when ordinary water cooler structures including inverted five-gallon water bottles set atop stands were utilized to display and dispense non-carbonated beverages. Those early machines were found to take up too much space, required premixing beverages in supplies of beverage bottles and required frequent manual replacement of empty beverage bottles with full beverage bottles.

Throughout the ensuing years, there has been a continuous effort on the part of those skilled in the art to reduce those shortcomings and inconveniences associated with the manufacture, use and maintenance of such machines and to enhance all of the desirable aspects thereof.

As of this date, the above-noted class of machines has evolved to include extremely neat and attractive counter-top machines with one- or two-gallon beverage supply tanks. The machines include mixing heads adjacent the beverage tanks and connected with remote water and beverage concentrate or syrup supplies by means of elongate water and syrup lines or hoses. The mixing heads are controlled by liquid-level sensing devices in the beverage tanks and function to deliver correctly metered volumes of water and syrup into the tanks to make beverage therein and to maintain the level of beverage in the tanks at or between attractive levels.

The above-noted state-of-the-art machines take up little counter space, operate to cool and to effectively display the beverages dispensed thereby; and, operate to maintain the tanks substantially full at all times, until the supplies of syrup are exhausted.

In recent years, the manufacturers and suppliers of beverage concentrate syrups have provided syrups in various kinds and sizes of containers with the view of making the supplying and handling of those syrups more convenient and cost-effective. Most recently, attention has been given to the supplying of syrup in large volume tanks (syrup tanks) that can be pressurized with $CO_2$ gas to effect transfer of the syrups from the tanks, through syrup hoses or lines, to the mixing heads of related machines. The use of such pressurized tanks is proving to be highly favored since most places where beverage dispensing machines of the class here concerned with are used also make and sell carbonated beverages (such as colas) and are equipped with $CO_2$ gas cylinders that can be most conveniently used to pressurize the syrup tanks. With the noted gas-pressurized syrup tanks, the beverage dispensing machines need not be provided with those special, costly and oftentimes inconvenient to use and maintain syrup transporting and/or pumping devices that are otherwise required to effect the transporting of syrup from remote syrup supplies to the machines.

The principal shortcoming that has been experienced with the use of pressurized syrup supply tanks resides in the fact that when the syrup tanks are empty the machines continue to operate to deliver notable volumes of water into the beverage tanks of the machines without corresponding volumes of syrup. When the foregoing occurs, the beverages in the beverage tanks are diluted with water and are rendered unmerchantable and such that they must be disposed of. Further, when empty syrup tanks are replaced with new or full tanks and the machines are put back into operation, the machines only deliver water into the beverage tanks until the syrup lines extending from the syrup tanks to the mixing heads of the machines are once again filled with syrup or primed. In a great number of situations, the syrup lines are of sufficient length and of such volumetric extent that before syrup has flowed from the syrup supply tanks and reached the mixing heads, sufficient volumes of water have flowed into the beverage tanks to dilute the beverages therein to an extent that they must be disposed of. When this occurs, the machines must be put out of service and worked upon a sufficient period of time to effect draining and disposal of diluted beverages and that further period of time that is required for the machines to make and refill the beverage tanks with vendable supplies of properly constituted beverages. The wasted service time and the waste of product experienced in furtherance of the foregoing are costly and are of great concern to the owners and operators of beverage dispensing machines.

It is understood that in efforts to overcome the above-noted problems and/or shortcomings experienced in the use of pressurized syrup supply tanks in combination with the class of beverage dispensing machines here concerned with, some persons skilled in the art have proposed the adding and use of special valves and the exercise of special operating procedures to effect priming of the syrup hoses with syrup before the machines are put into regular operation and to thereby prevent the making of diluted beverages that must be disposed of, as noted above. It is understood and believed that those special operating procedures that must be exercised to effect priming the syrup lines with syrup prior to putting the machines into operating service are not only time-consuming but are procedures that, if followed at all, are likely to be exercised improperly by those persons who are normally charged with the maintenance and operations of such machines.

It is to be noted that some prior art machines are equipped with syrup-sensing devices at the syrup inlets of their mixing heads and/or at the downstream ends of the syrup hoses that operate to turn the machines off and stop operation thereof when their related syrup supplies are exhausted and to thereby prevent dilution of beverages in the beverage tanks by continued flow of water into them. It is to be further noted that such syrup sensing devices do not operate to prevent the syrup lines, downstream of the machines, from being purged and emptied of syrup when the supplies of syrup for the machines are exhausted and are not operable to effect refilling or priming of the syrup lines with syrup when the machines are first put back into operation and before water is caused to flow into the beverage tanks in a manner to cause dilution of beverage therein.

OBJECTS AND FEATURES OF THE INVENTION

It is an object of this invention to provide a novel beverage dispensing machine of the general character referred to above having novel means to control the flow of pressurized water and syrup through the mixing head and into the beverage tank thereof so that no volume of water is caused to flow into the beverage tank without a corresponding volume of syrup being delivered into the tank.

It is an object and a feature of the invention to provide a beverage dispensing machine of the general character referred to above where the mixing head includes normally closed electrically operated water and syrup valves with downstream sides opening to the beverage tank and upstream sides connected with elongate water and syrup hoses or lines extending to a remote water service system and to a remote pressurized syrup supply tank, a liquid level actuated switching device in the beverage tank to intermittently simultaneously open and close the water and syrup valves to effect the flow of water and syrup into the beverage tank to maintain the beverage tank with a desired volume of beverage; and, a syrup actuated switching device upstream of the syrup valve and operating to disable and prevent opening of the water valve when the syrup valve is not supplied with a usable supply of syrup.

It is a further object of the invention to provide a beverage dispensing machine of the character referred to above wherein the syrup actuated switching device includes a normally open float actuated switch within a vertically extending accumulator chamber having an inlet connected with the downstream end of the syrup supply line and an outlet connected with the upstream side of the syrup valve; said fluid actuated switch is operated to close when syrup rises in the accumulator to an operating level below the top of the chamber where pressure equilibrium is established between the syrup and gas trapped in the chamber above the syrup.

The foregoing and other objects and features of the invention will be apparent and will be fully understood from the following detailed description of the invention throughout which description reference is made to the accompanying drawings.

DETAILED DESCRIPTION OF THE INVENTION

Figures 1, 5:
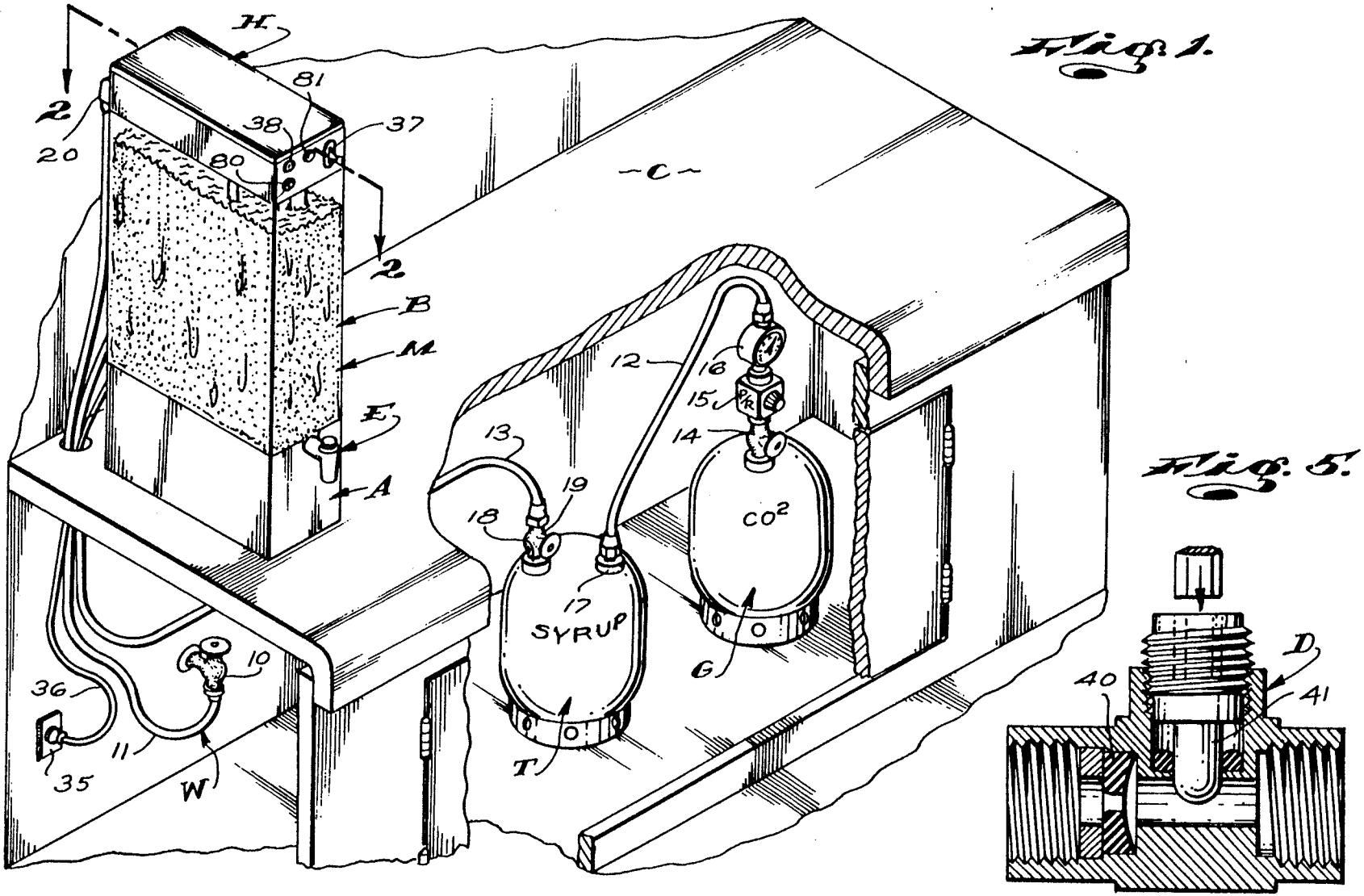
FIG. 1 is an isometric view showing a beverage dispensing means embodying the invention in combination with related water and syrup supplies.
FIG. 5 is a sectional view taken substantially as indicated by Line 5—5 on FIG. 2; and, FIG. 6 is a diagrammatic view of the invention.

In the drawings, I have illustrated one preferred embodiment of my improved beverage dispensing machine M in combination with a typical pressurized water supply W and a typical syrup supply S. The machine is shown supported atop a service counter C. The machine M is connected with a valve 10 of a common pressurized service system (not shown) by an elongate water hose or line 11. The valve 10 is located in cabinet space below the counter C and the water line 11 extends up from the valve 10 through an opening provided in the counter C, substantially as shown in FIG. 1 of the drawings. The water supply W provides the machine M with a constant supply of water at a substantially constant pressure. The syrup supply S includes a syrup supply tank T that is shown stored in the cabinet space below the counter C, a gas supply including a gas cylinder or tank G stored in the cabinet in convenient spaced relationship from the tank T, a gas line 12 extending from the tank G to the tank T; and, a syrup line 13 extending from the tank T, through the opening in the counter C and to the machine M.

The tank G is a typical or standard gas ($CO_2$) supply tank such as is commonly used in restaurants, beverage counters and the like. In accordance with common practice, the tank G has a manually operable outlet valve 14 at its top, a manually adjustable pressure regulator 15 connected with and downstream of the valve 14 and a pressure gauge 16 connected with and downstream of the pressure regulator 15. The gas line or hose 12 is connected with the downstream side of the pressure gauge 16.

The syrup tank T is an elongate vertically extending high-pressure tank in which a discrete volume of syrup is contained and from which said syrup can be dispensed. The tank T can, for example, hold five gallons of syrup. Five gallons of syrup is a sufficient volume of syrup to make 25 gallons of beverage when the ratio of water-to-syrup is 5-to-1.

The tank T has a gas inlet fitting 18 at its top with which the downstream end of the gas line 12 is suitably connected.

The tank T next includes or has a syrup outlet fitting 18 with a manually operable shut-off valve 19 with which the upstream end of the syrup hose or line 13 is suitably connected. In practice, the fitting 18 and valve 19 are at the top of the tank G and a stand pipe 20 extends from the fitting 18 into the tank to terminate in close proximity to the bottom thereof, as clearly shown in FIG. 6 of the drawings.

With the syrup supply S described in the foregoing and illustrated in the drawings, it will be apparent that the tank T can be easily and conveniently pressurized with gas from the tank G and that the pressure therein can be adjusted by means of the pressure regulator 15 to a desired operating pressure. The gas pressure in the tank T moves syrup in the tank out through the syrup line 13 at said desired operating pressure.

In practice, the fittings 17 and 18 of the tank T can be connected with and carry parts of quick disconnect fittings with check valves therein and that releasably connect with corresponding or mating quick disconnect parts at the downstream end of the gas line and upstream end of the syrup line.

In practice, one or more, full, replacement syrup tanks are stored in close and convenient proximity to the tank T so that when the tank T is exhausted of syrup, it can be easily and quickly replaced with another like tank with a full supply of syrup.

The machine M, as shown, includes a counter-supported base A and a beverage supply tank B projecting up from the base. Accessible at the front of the base and adjacent the lower end of the beverage tank is a suitable beverage dispensing valve E to effect dispensing of beverage in the tank B into serving receptacles such as drinking cups or glasses (not shown) as circumstances require.

In practice, the base A of the machine M houses refrigeration means (not shown) to cool the beverage in the tank B and includes beverage circulating means (not shown) that operates to maintain the beverage in the tank B in motion in an aesthetically pleasing manner and so that its ingredients do not separate.

In the form of the invention illustrated, the top of the tank B is closed by a rectilinear box-like housing H. The housing H has water and syrup inlet fittings 20 and 21 with downstream ends accessible within the housing and with upstream ends at the exterior of the housing and connected with the downstream ends of the water and syrup lines 11 and 13, as clearly shown in FIG. 2 of the drawings.

Within the housing H is a mixing means or head that operates to start and stop a metered flow of water and syrup delivered to the machine through the lines 11 and 13, to combine the water and syrup flowing therethrough to establish beverage and to deliver that beverage into the beverage tank.

The mixing head first includes normally closed, electrically operated water and syrup valves V and V' with inlet or upstream sides and outlet or downstream sides. The inlet or upstream sides of the valves V and V' are suitably connected with their related water and syrup inlet fittings 20 and 21 (and with their related water and syrup lines 11 and 12). The outlet or downstream sides of the valves V and V' open to the upstream end of a liquid mixing chamber 28. The downstream end of the chamber 28 communicates with the upper end of an elongate vertically extending beverage delivery tube 26 that depends from the housing H into the beverage within the tank B, as diagrammatically illustrated in FIG. 6 of the drawings.

In operation, water and syrup flowing through and from the valves V and V' into the chamber 28 in which they are suitably combined. The combined water and syrup flow from the chamber 28 into the tube 26 where they are more fully combined and let to drain down into the tank B.

In practice, the mixing chamber 28 and tube 26 could be eliminated and the valves V and V' could be let to discharge directly into the tank B without departing from the broader aspects and spirit of this invention.

Figure 6:
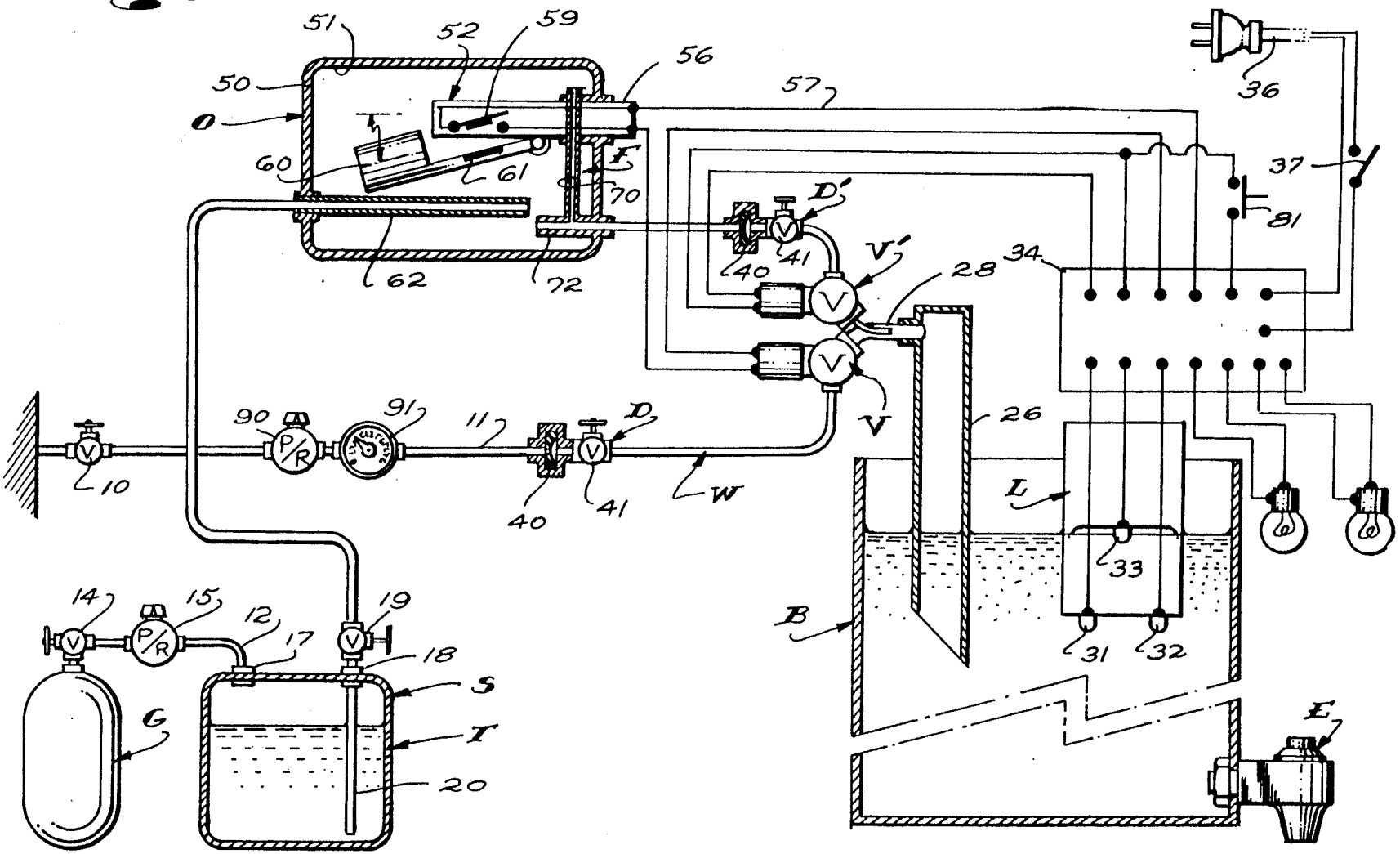

In FIG. 6 of the drawings, the valves V and V' are diagrammatically illustrated as separate valve units the outlet sides of which connect with that subassembly made up of the mixing chamber 28 and tube 26. The valves V and V', chamber 28 and tube 26 establish that subassembly of parts that I referred to as the mixing head.

Figures 2, 3, 4:
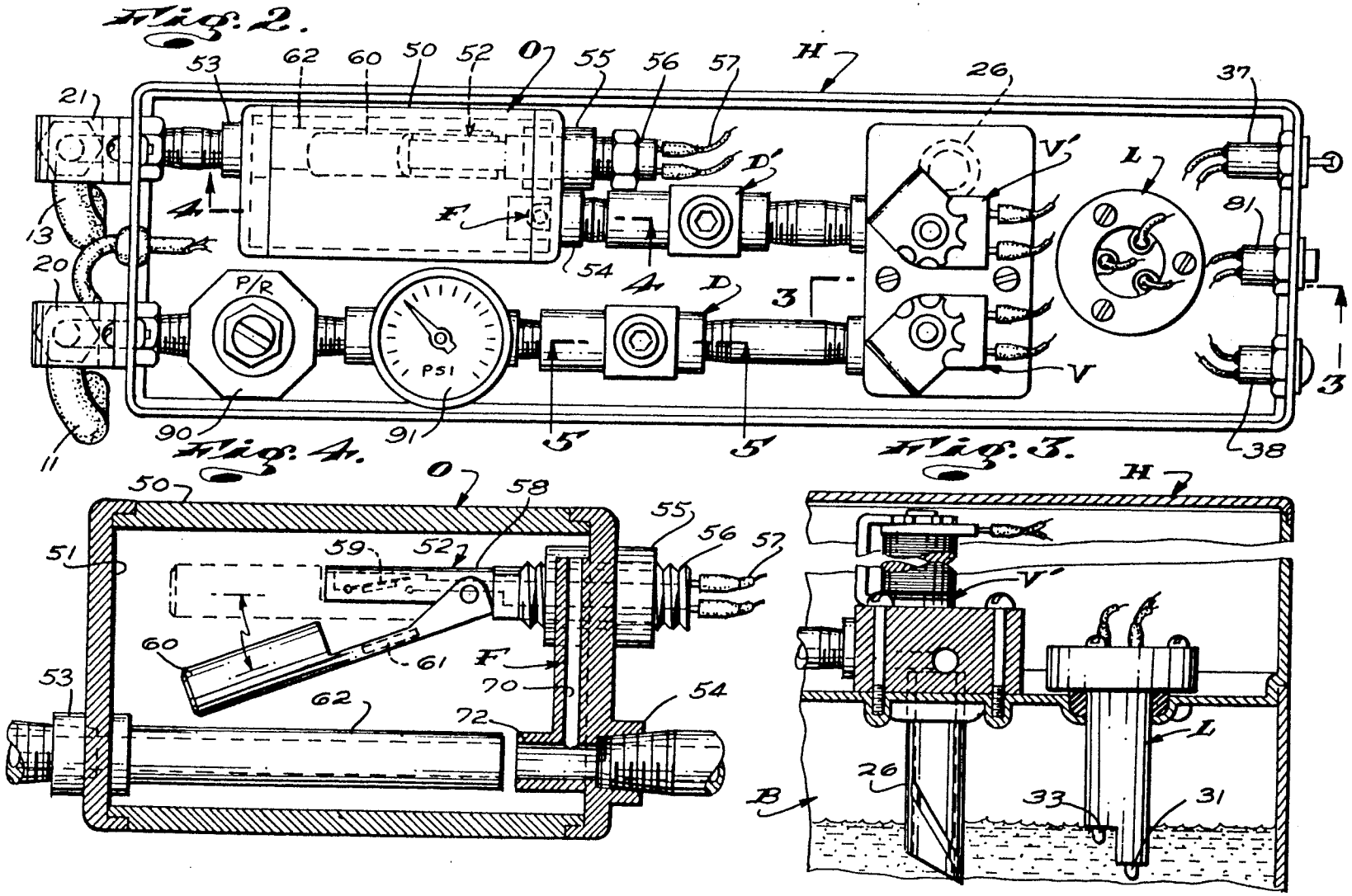
FIG. 2 is a plan view of the mixing head taken substantially as indicated by Line 2—2 on FIG. 1.
FIG. 3 is a sectional view taken as indicated by Line 3—3 on FIG. 2.
FIG. 4 is a sectional view taken substantially as indicated by Line 4—4 on FIG. 2.

In my reduction to practice of the invention, the valves V and V' and the mixing chamber are parts and/or portions of a block-like unitary body mounted within the housing H and with which the tube 26 is connected, to depend therefrom. In FIGS. 2 and 3 of the drawings, I have shown the valves V and V' and the upper end of the tube 26 within such a body.

The machine M next includes a liquid level actuated switch unit L carried by the housing H to depend therefrom into the tank B. The liquid level switch unit L is connected (indirectly) with the valves V and V' and operates to energize and cause the valves V and V' to open when the liquid level in the tank B drops to a predetermined low level and to de-energize and cause the valves to close when the liquid level in the tank B rises to a predetermined high level.

While there exists several float-operated switch unit that might be advantageously used in carrying out my invention, it is preferred that the unit L be a probe-type liquid level switch unit. In the case illustrated, the unit L includes an elongate probe that depends from the housing H into the tank B and that includes a pair of laterally spaced lower terminal pins 31 and 32, a circuit between which is closed by liquid in the tank and which is opened when the liquid level in the tank drops to a predetermined low level, below those terminals. The device L next includes an upper terminal 33, spaced below the lower terminals. The terminal 33 is grounded in the liquid in the tank when the liquid level in the tank reaches a predetermined high level. The several terminals 31, 32 and 33 are connected with a suitable circuit board 34 that is mounted within the housing H. The circuit board 34 is connected with an electric service outlet 35 by a service cord 36 that exits the housing H and extends to the outlet 35 as shown in FIGS. 1 and 2 of the drawings. In practice, the circuit board, diagrammatically shown in FIG. 6 of the drawings, is fastened to the underside of a removable cover or top wall of the housing H. In the case illustrated, the power supply to the circuit board 34 is under control of a switch 37 carried by the housing and a signal lamp 38, carried by the housing, is provided to indicate when the machine is in and out of service.

The valves V and V' are connected with the board 34 so that when the liquid level in the tank B drops to or below its predetermined low level, the valves V and V' are simultaneously energized or operated to open and to effect the delivery of metered volumes of water and syrup into the tank to make new beverage therein. The valves V and V' remain open until the liquid level in the tank reaches its predetermined high level, at which time, the valves V and V' are de-energized or closed to stop the flow of water and syrup into the tank. The valves V and V' remain closed until such time as the liquid level in the tank once again reaches its predetermined low level.

The parts and portions of the machine M thus far described are old art and can vary widely without departing from the broader aspects and spirit of this invention. In particular, the electric circuitry carried by the board 34 can be varied widely and in practice is a multipurpose board that is used in a number of different and distinct machines to effect and control the operation thereof. Accordingly, further detailed illustration and description of the above-noted structure need not and will not be entered into.

In addition to the foregoing, the means within the housing H further includes fluid metering devices D and D' immediately upstream of and communicating with the valves V and V'. Each of the devices D and D' is shown as including an orifice part or 40 through which a constant volume of liquid will flow throughout a wide range of pressures; and, a manually adjustable metering valve 41 downstream of the orifice 40. A preferred structural embodiment of one such metering device is clearly illustrated in FIG. 5 of the drawings.

It is to be noted that the ratio of water-to-syrup for the majority of commercial noncarbonated beverages is 5-to-1. Slight deviations from the prescribed ratio of water and syrup results in beverages that are too strong or too dilute to satisfy prescribed standards. It is understood that most prior art beverage machines of the character here concerned with provide and utilize orifice devices or provide and utilize metering valves to effect proper metering of water and syrup. The effectiveness of one or the other of those devices to attain the desired end results has proven to be marginal or undependable. This is largely due to fluctuations or variations of pressure on the liquids downstream of the devices. With the metering 40 in combination with valves 41 D and D' here provided, the orifice devices operate to deliver near-to-desired metered flows of fluids and the adjustable valves downstream thereof are operable to further adjust or "fine tune" the flow of liquids through and from the devices D and D'. With the dual function of the devices D and D', highly accurate metering of liquids is substantially assured.

With the structure thus far illustrated and described, the machine M will automatically operate to make and maintain a desired volume of beverage in the tank B until the supply of syrup in the syrup tank T is exhausted. When the foregoing occurs, high-pressured gas introduced into the tank T flows out of that tank through the syrup line 13 and thence into the beverage tank B while water is caused or let to continue to flow into the tank B. The foregoing results in diluting the beverage in the tank B and, as a general rule, so dilutes beverage in the tank that the tank must be emptied and refilled with a properly constituted supply of beverage.

When the supply of syrup in the syrup tank T is exhausted, the tank T must be disconnected from the gas line 12 and the syrup line 13 and a new or full tank must be put in its place and connected with the lines 12 and 13.

When a new tank is connected, it is first pressurized or charged with gas. Thereafter when the machine is first put into operation, to produce and deliver beverage (water and syrup) into the beverage tank T of the machine, the machine will first operate to deliver only water into the beverage tank. It will continue to deliver only water into the syrup tank until it has operated a sufficient period of time to allow syrup to flow from the syrup tank T through the syrup line, to and thence through the syrup valve V. It is not infrequent that the volume of syrup required to fill the syrup line is equal to more than 5% of the volume of the beverage tank B. Accordingly, when the machine is first put into operation, the first batch of beverage made and delivered into in the beverage tank is diluted with 5% (or greater) excess water, is unmerchantable and must be disposed of. The disposal of diluted beverage in the tank B is extremely inconvenient, time-consuming and costly. To prevent the foregoing from occurring, the present invention provides a novel syrup-actuated switching device O that operates to disable the normally closed water valve V until the system downstream of the syrup valve V is fully primed or charged with syrup and syrup commences to flow into the syrup valve V', at which time the water valve is once again enabled and opens to cause water to flow through the valve V and to combine with syrup flowing through the valve V', as desired.

In addition to the foregoing, the switching device O operates to disable and prevent opening of the valve V when the supply of syrup is exhausted and thereby prevents the continued flow of water into the beverage tank of the machine that might otherwise dilute any beverage remaining in that tank.

The switching device O is shown as including a block-like case 50 defining an accumulator chamber 51 in which a float-actuated shut-off switch 52 is positioned.

In the preferred carrying out of the invention and as shown in FIGS. 2, 4 and 6 of the drawings, the case or accumulator 50 has vertical upstream and downstream end walls, vertical side walls and horizontal top and bottom walls.

The upstream end wall has a fluid or syrup inlet fitting 53 and the downstream end wall has a fluid or syrup outlet fitting 54. The fittings 53 and 54 are in the lower portions of their related walls to occur at the lower portion of the accumulator chamber 51. One of the end walls is formed with a threaded port or carries a threaded mounting tube 55 to accommodate and carry the switch 52. The switch 52 is an elongated horizontal float-actuated mercury switch unit that includes a body 56 with inner and outer ends and that is threadedly engaged in and carried by the tube 55 with its outer end accessible at the exterior of the case or accumulator 50. The outer end of the body 55 has a pair of switch terminals that are connected in a power supply line 57 that connects the water valve V with the circuit board 34, substantially as shown in FIG. 6 of the drawings. The body 56 has a probe or stem 58 at its inner end. The stem 58 projects freely into the upper portion of the accumulator chamber and carries a normally open magnetically actuated switch 59 that is connected across the above-noted switch terminals. The switch unit 52 next and finally includes an elongate float 60 that carries an actuating magnet 61. One end of the float is suitably pivotally mounted to the stem 58 and normally extends downwardly and inwardly from the probe into the accumulator chamber 51 where the magnet 61 is out of operating range from the switch 59. When the machine is in operation, the float 60 is buoyed and pivoted up by syrup in the chamber to a nearly horizontal position where the magnet 61 actuates the switch 59 to a closed position. When the supply of syrup to the machine is exhausted and the fluid level in the accumulator drops, the float 60 pivots downwardly, moving the magnet 60 away from the switch 59 and causing the switch 59 to open.

The device O is arranged in the housing H with its fluid inlet fitting 53 connected with the downstream end of a syrup inlet fitting 62 with which the syrup line 13 is connected, substantially as shown in FIG. 2 of the drawings. The outlet fitting 54 is connected with the upstream end of the metering device D', which in turn is connected with valve V' as shown in FIG. 2 of the drawings.

The accumulator chamber 51 is normally filled with gas (air or $CO_2$).

When the machine M stands idle and is ready to be put into service and operated, the valves V and V' are closed so that no water supplied to the upstream side of the water valve can flow through that valve and into the beverage tank B and so that no syrup in the syrup tank T, at the downstream end of the syrup line 13, can flow. When operation of the machine is started, the syrup valve V' opens and syrup commences to flow from the tank T through the line 13, into and through the device O, through the metering device D' (which serves to restrict its rate and volume of flow) and thence, to and through and syrup valve V'. The metering device D' establishes a back pressure on the syrup that causes it to, in effect, back up and rise in the accumulator chamber 51 of the device O, compressing the gas in that chamber above the syrup therein and until the pressure on the gas in the chamber and on the syrup equalize. Equalization of the pressure on the gas is reached when the fluid level of the syrup in the chamber has reached a level where the switch 59 of the unit 52 closes and causes the water valve V to open, thus putting the machine into full operation where proper metered volumes of water and syrup are caused to flow into the beverage tank B of the machine. When this occurs, continued operation of the machine is left to be controlled by the fluid level switch unit L until such time as the supply of syrup for the machine is again exhausted.

In practice, it often takes a notable period of time for syrup entering the line 13 to evacuate gas from the system downstream of the syrup tank T and upstream of the syrup valve V'. However, after syrup has advanced through the metering device D and has reached the syrup valve V', the liquid level of syrup in the accumulator chamber 51 of the device O has or will shortly rise sufficiently in the chamber to effect closing of the switch 59 and opening of the water valve V.

Depending upon a number of variable factors, the water valve V might open a moment or two before or a moment or two after syrup has reached and commenced to flow through the syrup valve V'. The time of premature or delayed opening of the water valve V is so short that any excess of water or syrup that might be caused to flow into the beverage tank B of the machine M is negligible and such that the slight variation in quality or consistency of the beverage produced in the beverage tank T is not affected to any noticeable degree or extent.

In practice, it is preferred that the accumulator tank 50 be provided with baffle means to prevent syrup, when first entering the chamber 51, from turbulating therein in a manner to move and drive the float of the valve unit 52 in a manner to cause premature and erratic closing of the switch 59 thereof. To this end, in the form of the invention illustrated a flow tube 62 is connected with the downstream end or side of the syrup inlet fitting 53 to extend into the case and to direct inflowing syrup directly onto the downstream end wall of the case. The downstream end wall of the case acts as a baffle and causes inflowing syrup to flow in such a manner as not to interfere with the operation of the switching unit 52.

It has been found that there exists a tendency for gas to become trapped in the flow passageway defined by the structure that extends from the accumulator chamber 51 to the orifice part or device 40 in the metering device D' downstream of the device O. Gas trapped in that passageway tends to stop, slow or otherwise adversely affect the uniform and free flow of syrup therethrough. As syrup continues to flow into that passageway and to compress gas trapped therein, the gas tends to escape upstream in that passageway and to, in effect, "blast" into the accumulator chamber 51 and to disrupt and adversely affect desired and necessary operation of the device O. To prevent the foregoing from occurring, a means is provided to vent gases from the passageway that extends from the chamber 51 to the upstream side of the orifice device 40 in the metering device D'. To this end, the invention provides the gas vent means F shown in FIGS. 4 and 6 of the drawings.

The gas vent means F includes a gas vent passage 70 communicating with the top of the noted passageway and extending up therefrom to means to receive gas flowing therethrough, without the loss of pressure on the gas and without allowing for the escape of syrup. The means F is shown as including a flow tube 72 of limited longitudinal extent extending upstream from the outlet fitting 54 into the accumulator chamber 51 and defining an upstream portion of that passageway that is to be vented of gas. The tube 72 is shown formed integrally with the downstream end wall of the case 50. The vent passage 70 is formed in the downstream end wall of the case and extends vertically from the top of the tube 72 to the upper portion of the case where it opens into the chamber 51, above the switching unit 52.

It will be apparent that the vent means F can vary widely in practice. For example, that means might include a vent tube extending between and communicating with a passage in the metering device D', upstream of the orifice part therein and the top of the accumulator chamber 51 of the device O.

In the reduction to practive of the invention, the electrical circuit of the board 34 is such that if the circuits for the valves V and V' remain open when they should be closed or remain open when they should be closed and when other electrical components of the machine, such as refrigeration means and beverage circulating means malfunction, the board operates to disable the machine and energizes a warning light 80. Thus, when the switching device 50 operates to disable the water valve V, the circuit operates to disable the machine and energizes the light 80. In accordance with the foregoing, a push-button actuated primer switch 81 is provided to close the circuit to the syrup valve V', bypassing parts of the circuit, to open the valve V' when the machine is first put into operation (following the connection of a new syrup tank therewith). Accordingly, when the machine is first put into operation and before it becomes primed with syrup, the operator presses and holds the switch 81 closed until the light 80 is de-energized or turns off. It is seldom necessary to hold and depress the priming switch for more than five seconds. In practice, another and different circuit might be used to automatically effect priming of the machine with syrup and thereby eliminate the need for the priming surge switch 80.

Finally, the machine M is shown as including a water pressure regulator 90 within the housing H and connected with and between the metering device D and the water inlet fitting 20 carried by the housing and with which the water line 11 is connected. Further, connected with and between the pressure regulator 90 and the metering device D is a pressure gauge 91. The regulator 90 and gauge 91 enable the operator of the machine to properly and accurately adjust the pressure on the entering the device D to establish a suitable or desired water balance of pressure on the water at the device D with the pressure established on the syrup by operation of the aforementioned pressure regulator 15 (and gauge 16) through which gas is supplied to the syrup tank T.

Having described only one typical preferred form and embodiment of the invention, I do not wish to be limited to the specific details herein set forth but wish to reserve to myself any modifications and/or variations that might appear to those skilled in the art and which fall within the scope of the following claims.

Having described my invention, I claim:

1. A beverage dispensing machine including a beverage tank with a beverage dispensing valve, a mixing head including electrically operated normally closed water and syrup valves and operating to receive metered volumes of pressurized water and beverage concentrate syrup and to deliver them into the beverage tank; a fluid level actuated switch unit in the beverage tank and operating to cause the water and syrup valves to open simultaneously when the liquid level in the beverage tank reaches a predetermined low level and to close when the liquid level in the beverage tank reaches a predetermined high level, a water supply including an elongate water line extending between a pressurized water service system and the mixing head and to deliver water to an upstream side of the water valve; a syrup supply including a replaceable syrup tank holding a discrete volume of syrup, and elongate syrup line extending between the syrup tank and the mixing head to connect with an upstream side of the syrup valve, and a high-pressure gas supply connected with the syrup tank and delivering gas at a predetermined pressure into the syrup tank to move syrup therefrom to the syrup valve; a normally open syrup actuated switching device is connected with and between the syrup line and the syrup valve and is electrically connected between the fluid level actuated switch unit and the water valve, said normally open syrup actuated switching device normally disables and prevents opening of the water valve and closes and electrically enables and allows for opening of the water valve when syrup in the syrup tank is delivered to the syrup valve.

2. The machine set forth in claim 1 that includes a first pressure regulator engaged between and connected with the syrup tank and the gas supply; and, a second pressure regulator engaged between and connected with the water line and the water valve.

3. The machine set forth in claim 1 that includes a first flow metering device engaged between and connected with the syrup actuated switching device and the syrup valve; and, a second flow metering device engaged between and connected with the water line and the water valve.

4. The machine set forth in claim 2 that includes a first flow metering device between and connected with the syrup actuated switching device and the syrup valve; and, a second flow metering device between and connected with the second pressure regulator and the water valve.

5. The machine set forth in claim 3 wherein the first and second flow metering devices are flow metering orifices through which syrup and water moving downstream to the syrup and water valves flow.

6. The machine set forth in claim 3 wherein the metering devices are manually adjustable metering valves through which water and syrup moving downstream to the water and syrup valves flow.

7. The machine set forth in claim 3 wherein the first and second flow metering devices include flow-metering orifices and manually operable metering valves downstream of the orifices and through which water and syrup moving downstream to the water and syrup valves flow.

8. The machine set forth in claim 1 wherein the syrup actuated switching device includes a substantially horizontal case with upstream and downstream ends and defining an accumulator chamber that extends longitudinally and vertically between said ends, a syrup inlet fitting communicating with the lower portion of the chamber at the upstream end thereof, a syrup outlet fitting communicating with the lower portion of the chamber at the downstream end thereof, a normally open fluid level actuated switch in the chamber above the inlet and outlet fittings and connected to normally disable and prevent opening of the water valve, said fluid actuated switch is operated to close and to enable operation and opening of the water valve when the syrup valve is opened and the liquid level of syrup in the chamber rises to a level where pressures on the gas and syrup in the chamber are in substantial equilibrium.

9. The machine set forth in claim 8 wherein the syrup actuated switching device includes baffle means in the chamber to dampen turbulence of syrup flowing into and through the chamber.

10. The machine set forth in claim 9 wherein the syrup actuated switching device includes a gas vent extending between and in open communication with the upper portion of the chamber and a flow passage between the chamber and a flow metering device downstream of the chamber and upstream from the syrup valve.

11. A beverage dispensing machine including a beverage tank with a beverage dispensing valve, a mixing head including electrically operated normally closed water and syrup valves and operating to receive metered volumes of water and beverage concentrate syrup and to deliver them into the beverage tank; a fluid level actuated switch unit in the beverage tank and operating to cause the water and syrup valves to open simultaneously when the liquid level in the beverage tank reaches a predetermined low level and to close when the liquid level in the beverage tank reaches a predetermined high level, a water supply including an elongate water line extending between a pressurized water service system and an upstream side of the water valve; a syrup supply including a replaceable syrup tank holding a discrete volume of syrup, and elongate syrup line extending between and connected with the syrup tank and an upstream side of the syrup valve, and a high-pressure gas supply connected with the syrup tank and delivering gas at a predetermined pressure into the syrup tank to move syrup therefrom to the syrup valve; the machine includes a normally open syrup actuating switching device between and connected with the syrup line and the syrup valve and electrically connected between the liquid level switch unit and the water valve, said syrup actuated switching device normally disables and prevents opening of the water valve and closes and enables opening of the water valve when syrup in the syrup tank is delivered to the syrup valve; the syrup actuated switching device includes a substantially horizontal case with upstream and downstream ends and defines an accumulator chamber that extends longitudinally and vertically between said ends, a syrup inlet fitting communicates with the lower portion of the chamber at the upstream end thereof, a syrup outlet fitting communicates with the lower portion of the chamber at the downstream end thereof, a normally open fluid level actuated switch is in the chamber above the inlet and outlet fittings and is connected to normally disable and prevent opening of the water valve, said fluid actuated switch is operated to close and to enable operation and opening of the water valve when the syrup valve is opened and the liquid level of syrup in the chamber rises to a level where pressures on the gas and syrup in the chamber are in substantial equilibrium.

12. The machine set forth in claim 11 that includes a first pressure regulator between and connected with the syrup tank and the gas supply; and, a pressure regulator between and connected with the water supply line and the water valve.

13. The machine set forth in claim 11 includes a first flow metering device between and connected with the syrup actuated switching device and the syrup valve; and, a second flow metering device between and connected with the water supply line and the water valve.

14. The machine set forth in claim 12 that includes a first flow metering device between and connected with the syrup actuated switching device and the syrup valve; and, a second flow metering device between and connected with the second pressure regulator and the water valve.

15. The machine set forth in claim 13 wherein the first and second flow metering devices are flow-metering orifices through which syrup water moving downstream to the syrup and water valves flow.

16. The machine set forth in claim 13 wherein the metering devices include manually adjustable metering valves through which water and syrup moving downstream to the water and syrup valves flow.

17. The machine set forth in claim 13 wherein the first and second water metering devices include flow-metering orifices and manually operable metering valve downstream of the orifices and through which water and syrup moving downstream to the water and syrup valves flow.

18. The machine set forth in claim 11 wherein the syrup actuated switching device includes baffle means in the chamber to dampen turbulence of syrup flowing into and through the chamber.

19. The machine set forth in claim 18 wherein the syrup actuated switching device includes a gas vent extending between and connected with the upper portion of the chamber and a flow passage between the chamber and the syrup valve.

* * * * *